US008311433B2

(12) United States Patent
Shimizu

(10) Patent No.: US 8,311,433 B2
(45) Date of Patent: Nov. 13, 2012

(54) IMAGE FORMING DEVICE INCLUDING A CLEANING MEMBER AND A METHOD OF OPERATING THE SAME

(75) Inventor: Takatoku Shimizu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 462 days.

(21) Appl. No.: 12/656,381

(22) Filed: Jan. 28, 2010

(65) Prior Publication Data

US 2010/0196040 A1 Aug. 5, 2010

(30) Foreign Application Priority Data

Feb. 3, 2009 (JP) ..... 2009-023096

(51) Int. Cl.
*G03G 21/18* (2006.01)
*G03G 15/00* (2006.01)
*G03G 21/00* (2006.01)

(52) U.S. Cl. ..... 399/71; 399/114; 399/343

(58) Field of Classification Search ..... 399/71, 399/15, 82, 98, 99, 111, 114, 123, 343
See application file for complete search history.

(56) References Cited

U.S. PATENT DOCUMENTS 5,697,017 A * 12/1997 Rooke et al. ..... 399/71
2010/0054799 A1* 3/2010 Nakamura et al. ..... 399/114

FOREIGN PATENT DOCUMENTS

JP A-2001-324910 11/2001

* cited by examiner

*Primary Examiner* — Sophia S Chen
(74) *Attorney, Agent, or Firm* — Posz Law Group, PLC

(57) ABSTRACT

An image forming device having an detachable image forming unit that has an image carrier and an opening that exposes a part of the surface of the image carrier includes a determination unit that determines a cleaning time for the image carrier; and a rotation control unit that rotates the image carrier by a rotation unit that is less than or equal to a width of the opening, during the cleaning time.

19 Claims, 9 Drawing Sheets

IMAGE FORMING DEVICE INCLUDING A CLEANING MEMBER AND A METHOD OF OPERATING THE SAME

The present application is related to, claims priority from and incorporates by reference Japanese patent application number 2009-023096, filed on Feb. 3, 2009.

TECHNICAL FIELD

The present invention relates an image forming device that uses electrophotography, for example, a printer and a copying machine.

BACKGROUND

In an image forming device, the following processes are performed: (1) an electrostatic latent image is formed on a surface of a photoreceptor drum, which is uniformly charged by a charge roller, through exposing the surface by an exposure head; (2) the electrostatic latent image is developed by a thin layer of toner that is formed on a developing roller, so that a toner image is formed on the photoreceptor drum; and then (3) the toner image is transferred and is fused on a sheet of paper. For example, in an image forming unit that uses a single-component contact development system, toner is supplied from a toner cartridge. The toner is charged by frictional charge generated between a supply roller and a developing roller and between a regulation blade and the developing roller. Then, a thin toner layer is formed on the developing roller by the regulation blade.

The developing roller is configured to contact the photoreceptor drum, and charged toner is transferred on the electrostatic latent image so that the toner image is formed by charged toner and is created by an electric field formed on the surfaces of the developing roller and the photoreceptor drum. For example, in a direct transferring system in which the toner image on the photoreceptor is directly transferred to a sheet that is carried by a transferring belt, the toner image that is moved in a transferring area by the rotation of the photoreceptor drum is transferred to a sheet by electric field.

In the image forming device discussed above, when the toner image is transferred on the sheet from the photoreceptor drum by impressing a certain amount of charge to the toner, the following problems may occur. If the toner image is insufficiently charged, the toner image might not be transferred on the sheet but may remain on the photoreceptor drum. Toner that is damaged through repeated friction and an externally added agent, which is separated from toner, may be clumped together (agglomerated) and may adhere to the photoreceptor drum. Foreign particles and so on that are adhered to the transferring belt and the sheet may adhere to the photoreceptor drum.

Residual materials on the photoreceptor drum, such as residual toner or foreign particles, are collected by a cleaning device that is located at the downstream end of the transferring area in the photoreceptor drum. However, when the residual materials are heavily adhered to the photoreceptor drum, the residual materials cannot be completely removed from the photoreceptor drum with the cleaning device. As a result, the residual materials remain on the drum and create a film. The materials cause an image defect (or deteriorate the quality of the print image). In a conventional image forming device, a cleaning member is attached to a drum shutter that functions to protect the surface of the photoreceptor drum when an image forming unit is detached from the image forming device with a purpose of removing the residual toner and preventing the residual toner on the photoreceptor drum from creating a film. The residual toner and so on are removed by sliding the cleaning member on the surface of the photoreceptor drum when the drum shutter opens and closes at the time of detaching and attaching the image forming unit. See Japanese laid-open patent application publication number 2001-324910, especially, paragraphs 0025-0027 and FIGS. 3 and 4.

In the conventional technology discussed above, because the cleaning member is attached to the drum shutter and because the residual toner and so on are removed by the cleaning member sliding on the surface of the photoreceptor drum when the drum shutter opens and closes at the time of detaching and attaching the image forming unit, the areas that can be cleaned are restricted to the areas that the cleaning member, which is attached to the drum shutter, can contact. When the foreign particles and so on are adhered to the entire surface of the photoreceptor drum, the residual materials on the photoreceptor drum cannot be completely removed. Therefore, there is a problem that image defects may occur.

An object of the present invention is to provide an image forming device that can completely remove the residual materials even though the residual materials are adhered to the entire (circumferential) surface of an image carrier, such as the photoreceptor drum.

SUMMARY

In the disclosure of the present application, an image forming device having an detachable image forming unit that has an image carrier and an opening that exposes a part of the surface of the image carrier includes a determination unit that determines a cleaning time for the image carrier; and a rotation control unit that rotates the image carrier by a rotation unit that is less than or equal to a width of the opening, during the cleaning time.

Because the present invention has the structure discussed above, the present invention has the following effect. Even if residual materials are adhered to the entire surface of the image carrier, all such residual materials can be completely removed by cleaning the surface of the image carrier. The image quality results in improved quality.

DETAILED DESCRIPTION

An image forming device of an embodiment according to the present invention is explained below with reference to drawings.

Figure 1:
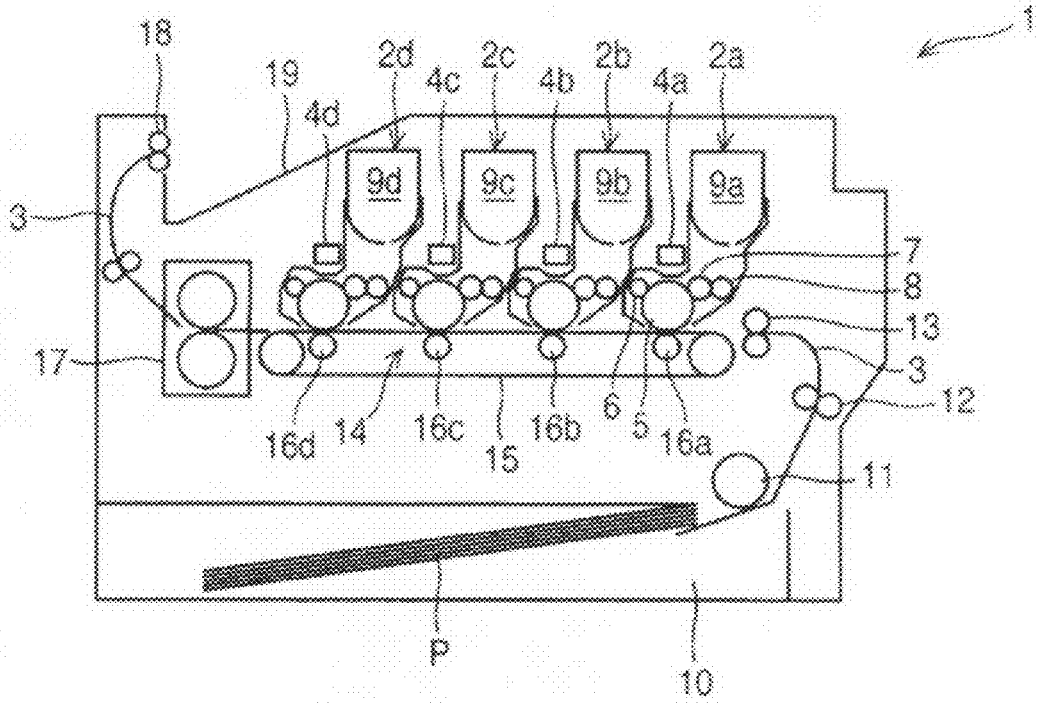
FIG. 1 is a side view of a rough structure of a printer of a first embodiment.

(First Embodiment) In FIG. 1, a reference numeral 1 is a printer as an image forming device. In this embodiment, the printer 1 uses a single-component contact development system. The printer 1 has process cartridges 2*a*-2*d* as image forming units that form each color image, such as K color (black), Y color (yellow), M color (magenta), and C color (cyan), respectively. The process cartridges 2*a*-2*d*, which are detachable from the printer 1, are arranged along the conveying direction in order from an upstream side of a conveying path 3, along which a sheet P, which is a medium to be printed, is carried.

Exposure heads 4*a*-4*d*, or exposure devices, that have light emitting diodes (LED) and so on as light emitting devices are located in areas to which the process cartridges 2*a*-2*d* face, respectively. The process cartridges 2*a*-2*d* have the same internal structures. When it is not necessary to distinguish among the cartridges, they are referred to as the process cartridges 2. The process cartridge 2 has an integrated structure in which a charge roller 6, or charge part, a developing roller 7, or developer carrier, and a supply roller 8, or developer supplying part, are located at the periphery of a photoreceptor drum 5, or image carrier.

Toner cartridges 9*a*-9*d* as developer cartridges are detachable from the process cartridges 2*a*-2*d*. The toner cartridges 9*a*-9*d* have toner in each developer color, respectively. The toner cartridges 9*a*-9*d* have the same internal structures. When the toner cartridges 9*a*-9*d* are attached to the process cartridges 2*a*-2*d*, respectively, a toner supply port is open. Therefore, each color of toner is supplied to the process cartridges 2*a*-2*d*, respectively.

In a lower part of the printer 1, a sheet feeding cassette 10, which stores a sheet P, and a hopping roller 11, which separates one sheet from the laminated sheets P and feeds the sheet P, are located. After the sheet P is fed to the conveying path 3 by the hopping roller 11, the sheet P is carried along the conveying path 3 by a pair of registration rollers 12 and 13, which correct the skew and so on of the sheet P. Then the sheet P is carried through each of the process cartridges 2 by a transferring belt unit 14.

Transferring rollers 16*a*-16*d*, or transferring parts, are located on an opposite side of a transferring belt 15 with respect to the photoreceptor drums 5 of each of the process cartridges 2 in the transferring belt unit 14. A voltage is applied to the transferring rollers 16*a*-16*d* to form electric fields at the photoreceptor drums 5, so that a toner image, or developer image, that is formed on the photoreceptor drums 5 is transferred to the sheet P. A fuser 17 has a heated roller and a backup roller. The toner image that is transferred to the sheet P is fused through pressing and heating by the fuser 17. The sheet P that is ejected from the fuser 17 is carried along the conveying path 3 and is ejected to a stacker 19 by ejecting rollers 18

Figure 2:
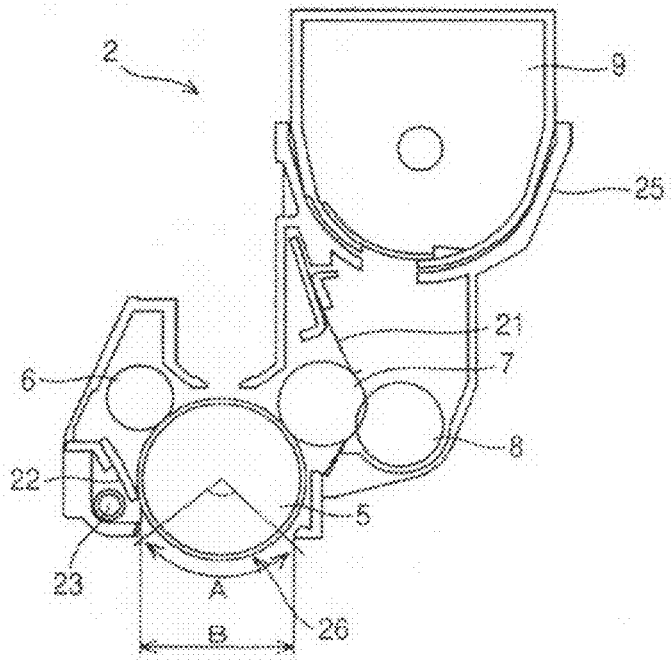
FIG. 2 is a side view of a process cartridge of a first embodiment.

FIG. 2 is a side view of a process cartridge of a first embodiment. The photoreceptor drum 5 has a driving gear 20 (see FIG. 5) at the end of the photoreceptor drum 5, as shown. The driving gear 20 rotates with respect to the process cartridge 2 and rotates integrally with the drum 5. A charge roller 6, to which a high voltage is applied, is driven according to the rotation of the photoreceptor drum 5, so that the charge roller 6 uniformly charges the surface of the photoreceptor drum 5.

The developing roller 7 has a gear (not shown) that mates with the driving gear 20 of the photoreceptor drum 5 at the end of the developing roller 7. The developing roller 7 is thus driven by the photoreceptor drum 5. The developing roller 7 forms an electric field between the surfaces of the developing roller 7 and the photoreceptor drum 5 by the applied high voltage and develops an electrostatic latent image that is formed on the surface of the photoreceptor drum 5, which is charged by the exposure of the exposure head 4, which is located to face to the photoreceptor drum 5.

The supply roller 8 has a gear at the end of the supply roller 8 and is driven by the developer roller 7. The supply roller 8 frictionally charges toner by sliding with the developing roller 7 and supplies the toner to the developing roller 7. A regulation blade 21 as a developer regulation part is an elastic blade in which one end is fixed to a holder and another end is located to press the developing roller 7, so that the regulation blade 21 frictionally charges the toner and regulates the thickness of the toner layer on the developing roller 7.

A cleaning blade 22, or cleaning member, collects and scrapes residual toner from the surface of the photoreceptor drum 5 after the transfer. The collected toner is carried from the process cartridge 2 to a waste toner box (not shown) by a collected toner carrying spiral 23. The process cartridge 2 of this embodiment is configured with the photoreceptor drum 5, the charge roller 6, the developing roller 7, the supply roller 8, the regulation blade 21, the cleaning blade 22, the collected toner carrying spiral 23, and so on. A frame 25 integrates the parts and has an opening 26. When the process cartridge 2 is attached to the printer 1, the opening 26 exposes the area of the photoreceptor drum 5 that includes a transferring area opposite to a transferring roller 16.

The length of the opening 26 in its longitudinal direction is equal to or longer than the length of the image forming area of the photoreceptor drum 5 in its longitudinal direction. The opening 26 has the opening width B in the conveying direction to expose the exposure length A of the outer surface of the photoreceptor drum 5 and is rectangular. The exposure length A is the circular length of the outer circumference of the photoreceptor drum 5 along the circumference of the photoreceptor drum 5, which is set as a scraping area by a cleaning member 47 (see FIG. 5). The exposure length A is chosen so that there is no problem in the conveying and transferring processes of the sheet P.

Figure 3:
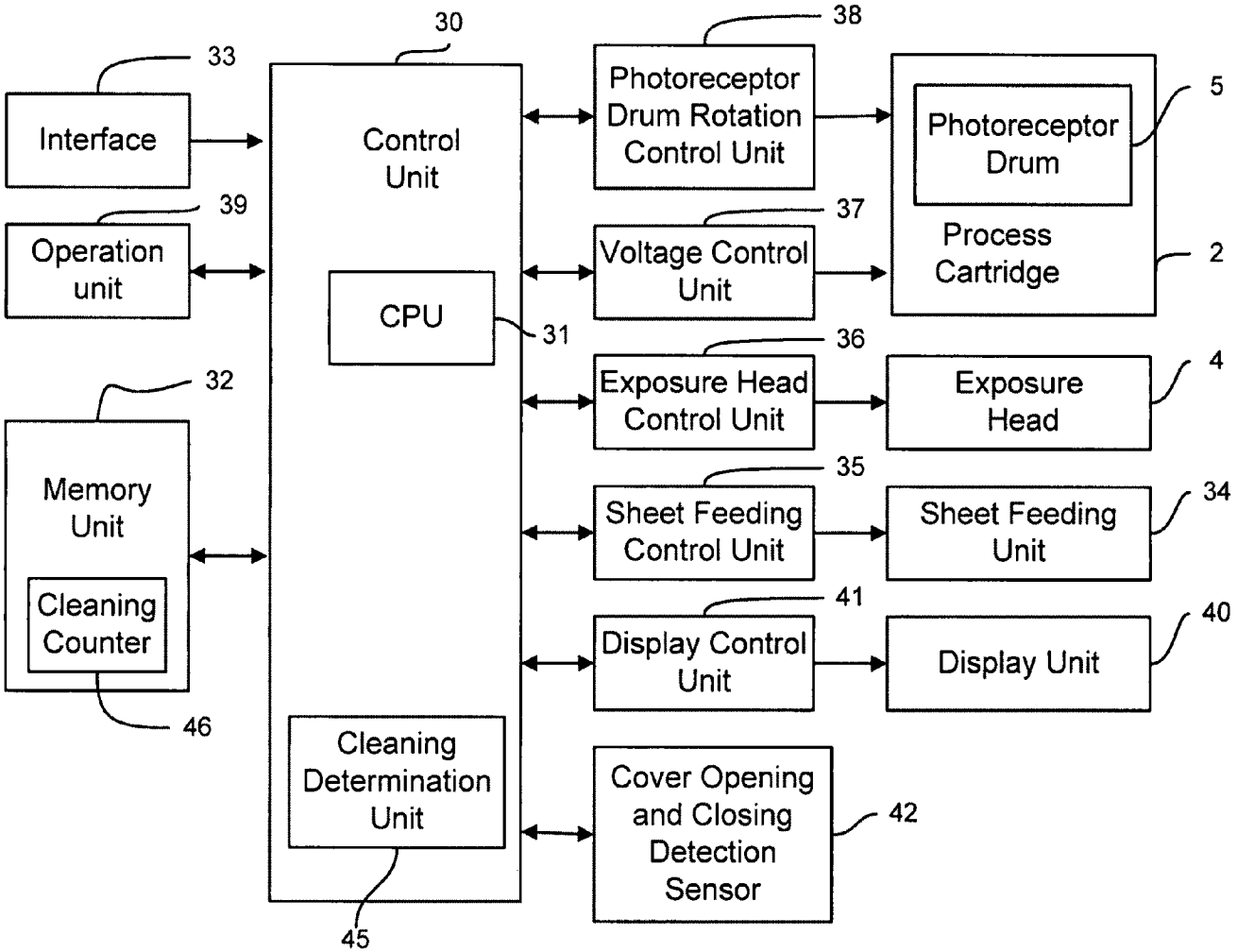
FIG. 3 is a block diagram showing a control system of a cleaning process of a first embodiment.

In this embodiment, the diameter of the photoreceptor drum 5 is 30 mm. The exposure length A of the photoreceptor drum 5 at the opening 26 is 26 mm. The opening width B at the opening 26 is the same length of the exposure length A. In FIG. 3, a control unit 30 has a central processing unit (CPU) 31 and controls each part of the printer 1, so that the control unit 30 controls an image forming process and so on.

A program that is executed by the control unit 30 is stored in a memory unit 32 in advance. Various kinds of data that are used for the program and processing results and so on of the control unit 30 are also stored in the memory unit 32. An image signal is sent from a host device (not shown) to an interface 33. When the control unit 30 receives the image signal, the control unit 30 sends a drive signal for driving each motor and so on to a sheet feeding control unit 35 that controls a sheet feeding unit 34 according to a print timing that is generated by the CPU 31.

Then, the sheet P is fed from the sheet feeding cassette 10, so that sheet feeding is initiated. Image data is sent to an exposure head control unit 36, which controls the light emitting operation of the exposure heads 4*a*-4*d*. When the sheet P reaches the process cartridges 2*a*-2*d*, a high voltage is applied to the following structures according to a control signal of a voltage control unit 37, the charge rollers 6, the developing rollers 7, and the transferring rollers 16. Because the exposure heads 4*a*-4*d* are lighted in response to the image data, electrostatic latent images are formed on each of the photoreceptor drums 5, the rotation of which is controlled by a photoreceptor drum rotation control unit 38. Toner images that are adhered to the electrostatic latent images are transferred to the sheet P.

Specifically, the photoreceptor drum rotation control unit 38 is configured, for example, with a drive transmission system that drives the photoreceptor drum 5 and a control system for controlling the speed of the photoreceptor drum 5. The drive transmission system is configured with a motor drive gear and a photoreceptor drum drive gear 20. The motor drive gear simultaneously rotates with an output shaft of the motor. The photoreceptor drum drive gear 20 is a driven gear that is positioned at one end of the photoreceptor drum. The motor drive gear meshes with the photoreceptor drum drive gear 20 so that the photoreceptor drum 5 rotates through a rotation of the photoreceptor drum drive gear 20 caused by the rotation of motor drive gear.

The control system includes a motor drive circuit and motor control part. The motor drive circuit functions to rotate the photoreceptor drum 5 with a predetermined speed. In addition, the motor drive circuit functions to maintain and adjust the rotation speed of the motor with high accuracy based on control information sent from the motor control part. The motor control part functions to control the motor drive circuit based on rotation speed information of an encoder equipped with the motor and drive start or stop information sent from the CPU 31.

The memory unit 32 stores a program for a control process that is used for the speed control of the photoreceptor drum 5. With such a program, the rotation of the photoreceptor drum 5 is controlled with high accuracy based on a difference that is obtained by a comparison of actually measured rotation speed information and predetermined (target) rotation speed information of the motor.

An operation unit 39 is located at a front cover of the printer 1 along with a display unit 40. The operation unit 39 has input keys, or an input means, for selecting a menu that is displayed at the display unit 40 based on display data that is sent from a display control unit 41 and for changing various settings. Cover opening and closing detection sensors 42 detect opening and closing of covers, such as a top cover and a side cover, which provide a user with access to the drums 5.

The control unit 30 enables operation of the image forming processing as long as the cover opening and closing detection sensors 42 detect closing of the cover. When the cover opening and closing detection sensors 42 detect opening of one of the covers, the control unit 30 suspends the image forming processing. In this embodiment, a cleaning mode can be selected from the menu that is displayed at the display unit 40. When the cleaning mode is selected by the input key of the operation unit 39, a cleaning determination unit 45 that is provided at the control unit 30 determines the cleaning mode. A rotation operation by one rotation unit (or rotation unit length) of a cleaning treatment is performed based on operation instructions of the cleaning treatment. The number of rotation units N (number of cleaning treatments) of the rotation operation is counted by a cleaning counter 46 that is provided in the memory unit 32.

The cleaning mode of the present embodiment has the following sequence to clean the entire surface of the photoreceptor drum 5. A rotation distance that is equal to or shorter than the opening width B of the process cartridge 2, i.e., a rotation distance that is equal to or less than the exposure length A of the photoreceptor drum 5, is set as one rotation unit for the rotation operation of the photoreceptor drum 5. When the photoreceptor drum 5 is rotated by one rotation unit by the photoreceptor drum rotation control unit 38, the photoreceptor drum 5 is cleaned by the cleaning member 47 at each rotation unit. When the cleaning treatment discussed above is repeated several times, the entire surface of the photoreceptor drum 5 is cleaned.

In this case, the rotation speed of the photoreceptor drum 5 can be arbitrarily-configured. In this embodiment, the rotation speed is set as the circumferential velocity, 180 mm/sec, and the rotation time is set as 0.13 sec. The rotation distance of the outer circumference of the photoreceptor drum 5 in one rotation unit is 23.4 mm. This rotation distance is shorter than the opening width B, 26 mm, of the process cartridge 2 and corresponds to the rotation distance of one fourth (¼) of the entire circumference of the photoreceptor drum 5.

Figure 4:
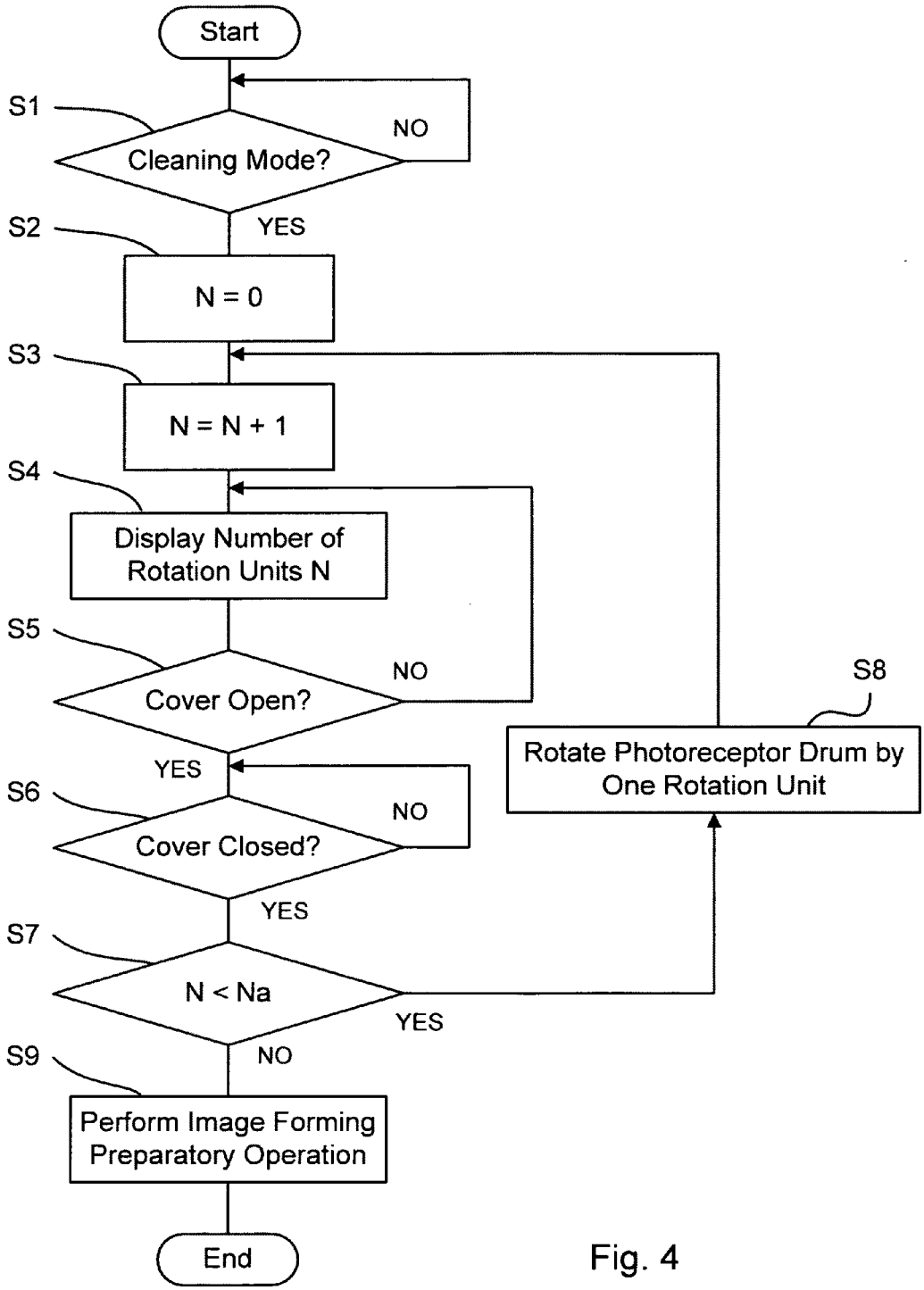
FIG. 4 is a flow diagram of a cleaning process of a first embodiment.

Therefore, a count upper limit Na of the number of rotation unit N is set as four and is stored in the memory unit 32. The cleaning treatment of the present embodiment is explained below according to the flow diagram shown in FIG. 4. The control unit 30 of the printer 1 controls each part of the printer 1 based on the image signal that is sent from an external device (not shown) and performs the typical image forming processing that forms an image on the sheet P.

When a user of the printer 1 finds an image defect in the image that is formed on the sheet P, the user selects the cleaning mode from the menu that is displayed at the display unit 40 by the input key of the operation unit 39. At S1, the control unit 30 waits for the selection of the cleaning mode while the image forming processing is performed. When the cleaning determination unit 45 determines that the cleaning mode has been selected, the operation proceeds to S2. If the cleaning mode is not selected, the control unit 30 continues waiting for the selection of the cleaning mode.

When another mode is selected, the control unit 30 performs the selected mode as usual. At S2, when the control unit 30 determines that the cleaning mode has been selected, the control unit suspends the operation of the image forming processing and initializes the number of rotation units N of the cleaning counter 46 in the memory unit 32 as zero to start the sequence of the cleaning mode.

At S3, the control unit 30 adds one as a count number to the number of rotation units N of the cleaning counter 46 so that the number of rotation units N is increased incrementally. Thus, at this stage, N is equal to one. At S4, after the control unit 30 increments the number of rotation units N, the control unit 30 reads the count upper limit Na from the memory unit 32 and the number of rotation units N from the cleaning counter 46 and instructs that a rotation unit screen be displayed, which has a message encouraging the cleaning of the photoreceptor drum 5 for the user, describing the treatment procedure of the cleaning task, displaying the number of rotation units N, and so on, at the display unit 40 by the display control unit 41.

In this case, the number of rotation units N is displayed as ¼ in which the count upper limit Na is the denominator. At S5, after the control unit 30 instructs the display of the rotation unit screen, the control unit 30 waits for a cover opening signal, which is output by the cover opening and closing detection sensors 42. When the cover opening and closing detection sensors 42 output the cover opening signal, the operation proceeds to S6. When the cover opening and closing detection sensors 42 do not output the cover opening signal, i.e., when the cover opening and closing detection sensors 42 outputs a cover closing signal, the operation returns to S4, so that the control unit 30 keeps waiting while the control unit 30 instructs that the number of rotation units screen be displayed.

At S6, when the control unit 30 determines that the cover opening signal is output, the control unit 30 waits for the cover closing signal that is output from the cover opening and closing detection sensors 42. When the cover opening and closing detection sensors 42 output the cover closing signal, the operation proceeds to S7. When the cover opening and closing detection sensors 42 do not output the cover closing signal, i.e., when the cover opening and closing detection sensors 42 output the cover opening signal, the control unit 30 continues waiting for the completion of the cleaning for the photoreceptor drum 5.

Figure 5:
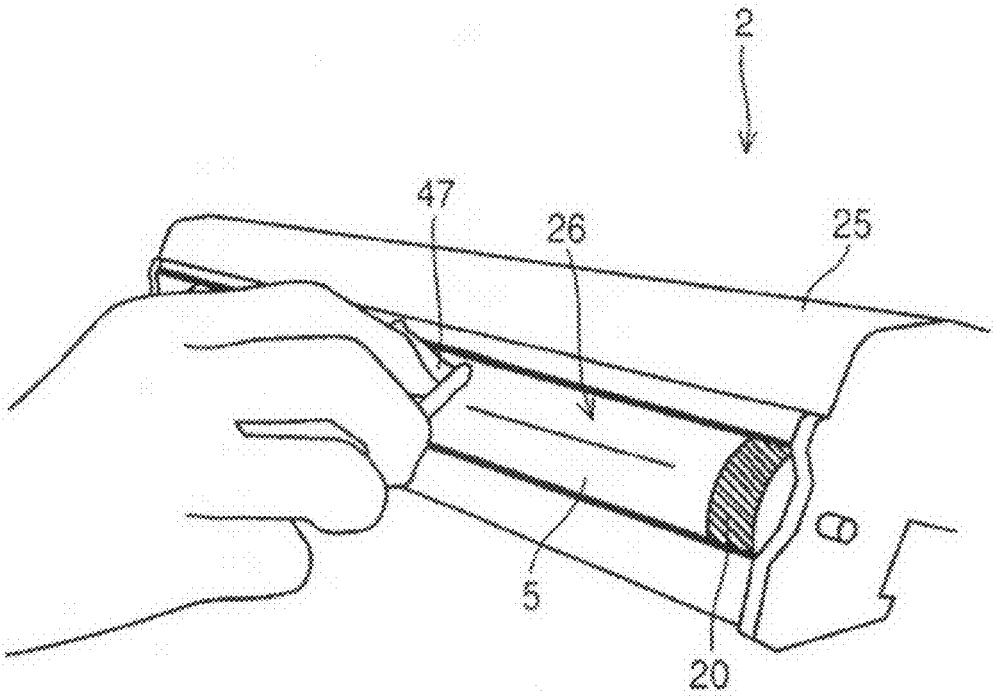
FIG. 5 is a schematic view of a cleaning task of a first embodiment.

The following is a description of the cleaning task performed by the user. After the number of rotation units screen is displayed, the user opens the cover (S5) and takes out the process cartridge 2 from the printer 1. As shown in FIG. 5, when the process cartridge 2 is laid down and is located on a table in which the opening 26 faces up, the residual materials are wiped off by the cleaning member 47. The residual materials, which are wiped off, are adhered to the surface of the photoreceptor drum 5 that is exposed through the opening 26. Therefore, the surface of the photoreceptor drum 5 is cleaned.

The cleaning member 47 can be made of materials that readily remove residual toner, foreign particles, clumps of externally added agent, and so on that are adhered to the surface of the photoreceptor drum 5 and that do not scratch the surface of the photoreceptor drum 5. Examples of the materials of the cleaning member 47 are gauze and nonwoven cloth. After the photoreceptor 5 is cleaned, the user attaches the process cartridge 2 to the printer 1 and closes the cover (S6).

At S7, the control unit 30 determines whether the Nth cleaning of the photoreceptor drum 5 is finished; that is, according to the cover closing signal, the control unit 30 compares the count upper limit Na with the number of rotation units N in the memory unit 32. When the number of rotation units N is equal to or more than the count upper limit Na (four in the present embodiment), the control unit 30 determines that the cleaning mode is finished and cancels the cleaning mode. Then, the operation proceeds to S9.

When the number of rotation units N is less than the count upper limit Na, the control unit 30 continues the cleaning mode. Then, the operation proceeds to S8. At S8, after the control unit 30 determines the continuance of the cleaning mode, the control unit 30 instructs the photoreceptor drum rotation control unit 38 to rotate the photoreceptor drum 5 by one rotation unit. Then, after the operation returns to S3, the cleaning of the photoreceptor drum 5 at the next number of rotation units N is performed with the same procedure discussed above until the number of rotation units N is equal to or more than four.

In the rotation by one rotation unit of the photoreceptor drum 5, exposure control of the exposure head 4 and applied voltage for the process cartridge 2 are set so that toner does not adhere to the photoreceptor drum 5. Specifically, the exposure head 4 does not light, and the applied voltages to the process cartridge 2 are as follows: −1000 V to the charge roller 6 and −200 V to the developing roller 7. At S9, when the control unit 30 determines the end of the cleaning mode, the control unit 30 performs an image forming preparatory operation.

Namely, the control unit 30 instructs the photoreceptor drum rotation control unit 38 to rotatably drive the photoreceptor drum 5 with a certain rotation speed and a certain rotation time. The control unit 30 also instructs the voltage control unit 37 to apply a certain voltage to each of the rollers in the process cartridge 2 and instructs that a charged thin layer be formed on the developing roller 7, so that the preparation of the image forming processing is performed. The operations of each part in the image forming preparatory operation are, for example, as follows: applied voltage to the process cartridge 2 is −1000 V for the charge roller 6 and is −200 V for the developing roller 7; the rotation speed of the photoreceptor drum 5 corresponds to the standard printing speed, 180 mm/sec, which is equivalent to a feeding speed of 36 pages per minute (PPM) of the sheet P in A4 size; the rotation time is sufficient to charge toner on the developing roller 7, i.e., approximately 1.6 sec. which that is equivalent to three rotations of the photoreceptor drum 5.

Because the photoreceptor drum 5 is cleaned in the cleaning mode, as described above, one circumference of the photoreceptor drum 5 is completely cleaned at the end of the cleaning mode. In the present embodiment, the count upper limit Na is four. However, the present invention is not limited to this embodiment. The setting of the count upper limit Na can be changed as long as each rotation distance is equal to or less than the opening width B by the operation unit 39.

For example, when the count upper limit Na is set as five, the rotation distance of one rotation unit of the photoreceptor drum 5 is set as 18.8 mm, which is one fifth (⅕) of one circumference of the photoreceptor drum 5. The cleaning mode continues until the cleaning counter 46 counts five as the number of rotation units N. The forced termination of the cleaning mode may be selected by the operation unit 39. In this case, the selection for the forced termination of the cleaning mode is monitored through parallel processing with the cleaning treatment. When the cleaning determination unit 45 determines the forced termination of the cleaning mode, the cleaning mode is canceled through interrupt processing even though the number of rotation units N has not yet reached the count upper limit Na. Then, the image forming preparatory operation is performed at S9.

In this embodiment, the following situation is explained as an example. When the number of rotation units N has reached the count upper limit Na, the cleaning mode is canceled. However, the present invention is not limited to this embodiment. The cleaning mode can continue when the number of rotation units N exceeds the count upper limit Na. When the number of rotation unit screen is displayed at S4, the cleaning mode can be canceled by selecting cancel from the menu of the display unit 40 through the operation unit 39. After the end of the cleaning mode is determined, the operation proceeds to S9. Then, the image forming preparatory operation is performed.

Additionally, a unit detection sensor, which detects whether the process cartridge 2 is attached to the printer 1, may be provided. When the control unit 30 detects closing of the cover at S6, and when the unit detection sensor does not detect attachment of the process cartridge 2, the rotation operation by one rotation unit of the photoreceptor drum 5 and the incrementing of the count for the number of rotation units N are not performed. A message that encourages that attachment of the process cartridge 2 is then displayed at the display unit 40, so that the control unit 30 may wait until the unit detection sensor detects the attachment of the process cartridge 2. As a result, the number of rotation units N and the actual rotation distance of the photoreceptor drum 5 can be synchronized.

In this embodiment, the opening 26 of the process cartridge 2 is located in the area that includes the transferring area opposite to the transferring roller 16. However, the present invention is not limited to this embodiment. The opening 26 may be located in the area that includes an exposing area opposite to the exposure head 4. The opening 26 need only be satisfactory for cleaning the surface of the photoreceptor drum 5. A rotation distance of the photoreceptor drum 5 that is equal to or less than the opening width B of the opening 26 is set as one rotation unit.

As explained above, in this embodiment, when the cleaning mode is selected, the photoreceptor drum 5 rotates by one rotation unit, which is equal to or less than the opening width B that is satisfactory for cleaning. Even though the residual materials, such as the residual film, are adhered to the surface of the photoreceptor drum, the residual materials can be completely removed by cleaning the surface of the photoreceptor drum with one rotation. As a result, the image quality can be restored.

Figure 6:
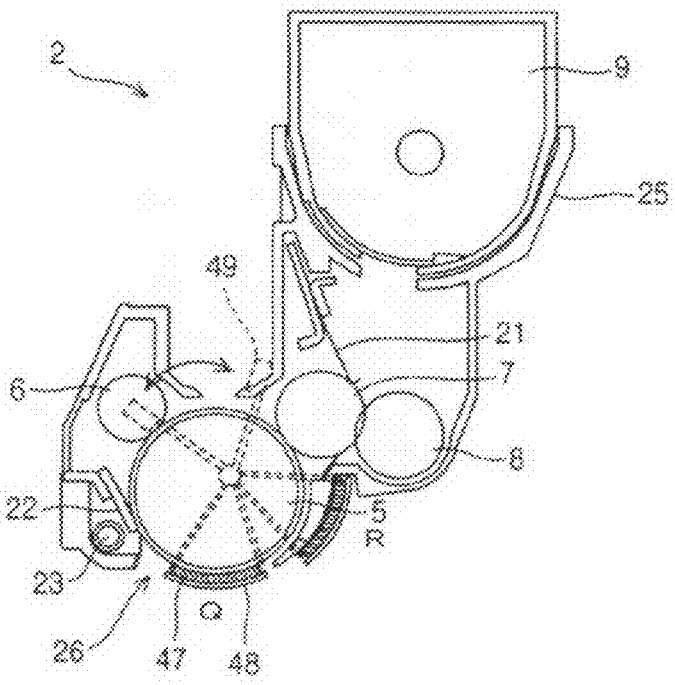
FIG. 6 is a side view of an alternative process cartridge of a first embodiment.

When foreign particles are adhered to the photoreceptor drum, image defects, such as white spots, appear on the image. Even though adhesion places on the photoreceptor drum cannot be identified, the adhesion places are certainly subject to cleaning by rotating the photoreceptor drum for one circumference through the cleaning mode without preparing special device and so on for rotating the photoreceptor drum. As a result, the image defect is removed through the cleaning. In this embodiment, the cleaning treatment for the surface of the photoreceptor drum 5 is explained as the user wipes out with the cleaning member. However, the present invention is not limited to this embodiment. As shown in FIG. 6, a drum shutter 48 is provided at the process cartridge 2 in which the drum shutter 48 protects the surface of the photoreceptor drum 5 by opening and closing the opening 26. The drum shutter 48 has the cleaning member 47 on the side that faces the photoreceptor drum 5. The photoreceptor drum 5 is cleaned with the cleaning member 47 through opening and closing the drum shutter 48 by shifting a lever 49 by hand. When the process cartridge 2 is attached to the printer 1, the cleaning member 47 is in the separated position R in FIG. 6. When the photoreceptor drum 5 (process cartridge 2) is taken out, and the surface of the photoreceptor drum 5 is cleaned in the cleaning mode, the cleaning member 47 can be moved to the contact position Q by operating the lever 49. As a result, the surface of the photoreceptor drum 5 is easily cleaned, and the burden on the user is diminished.

Figure 7:
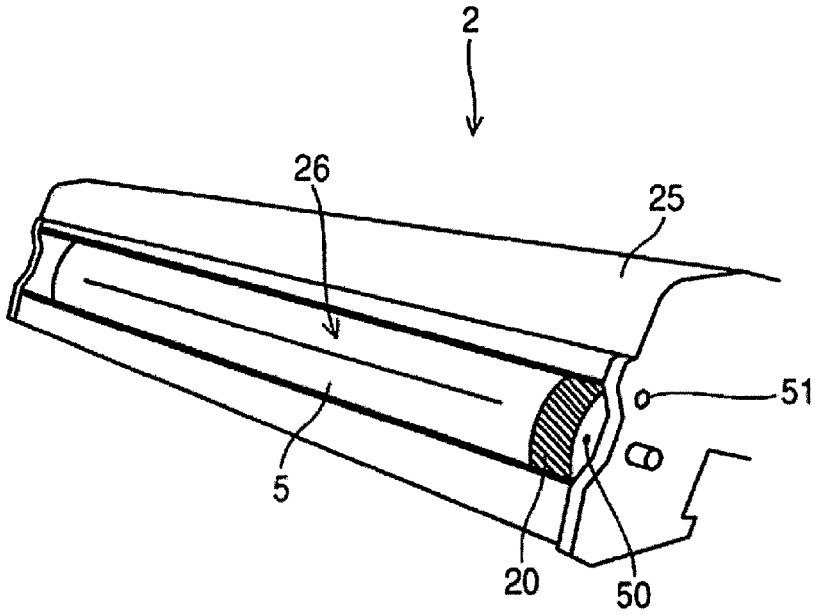
FIG. 7 is a schematic view of a position detecting mechanism of a second embodiment.

(Second Embodiment) In an explanation of this embodiment, the same reference numerals are used for the same corresponding structures of the first embodiment, and a detailed explanation for similar or identical parts is omitted. As shown in FIG. 7, a position mark 50, which shows the angular position of the photoreceptor drum 5, is located on one end face of the photoreceptor drum 5. A position detection sensor 51, such as an optical position detection sensor, is located at the frame 25 of the process cartridge 2 to detect the position mark 50.

In a cleaning mode of this embodiment, one rotation unit for the rotation operation of the photoreceptor drum 5 is set in the same manner of the first embodiment. One rotation unit is considered to be one of a number of areas to be cleaned (referred to as a cleaning area 53; see FIG. 8). First, a cleaning area detection pattern, which is for detecting the cleaning area 53, is oriented on a sheet P. When the cleaning area 53 is specified through user input, the surface of the photoreceptor drum 5 that corresponds to the specified area is exposed through the opening 26 by rotating the photoreceptor drum 5. Then, the specified area is cleaned by the cleaning member 47. The sequence for cleaning the entire surface of the photoreceptor drum 5 is set.

Figure 8:
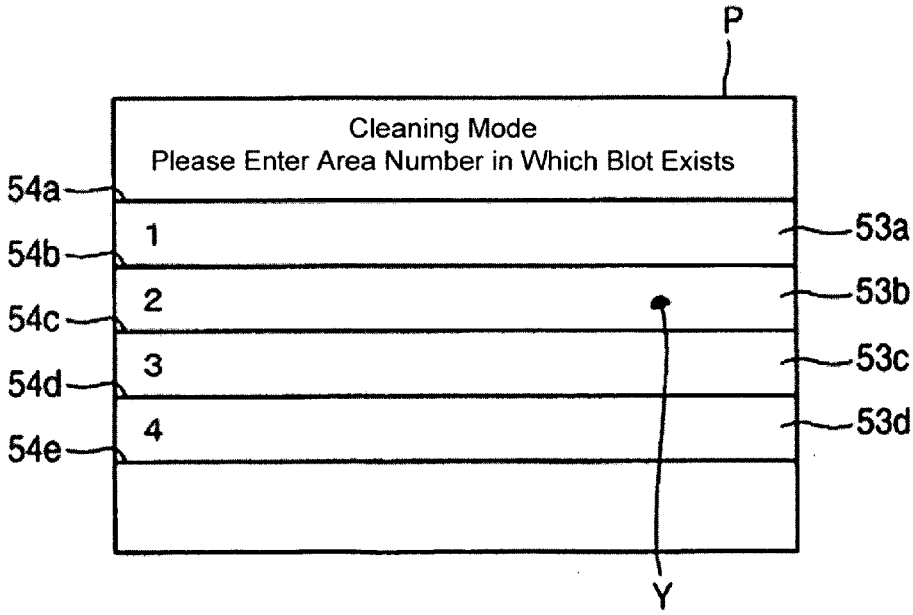
FIG. 8 is schematic view of a cleaning area detection pattern of a second embodiment.

Image data, which is for printing the cleaning area detection pattern on the sheet P except a blot Y shown in FIG. 8 through transverse feeding of the sheet P, is stored in the memory unit 32 in advance. As shown in FIG. 8, a plurality of the cleaning areas 53 including a mode name, a specifying method for the cleaning area 53, and an area number are printed on the sheet P in which the cleaning area detection pattern is printed.

The rotation speed and rotation distance by one rotation unit of the photoreceptor drum 5 of this embodiment is set in the same manner of the first embodiment. Four cleaning areas 53*a*-53*d*, which are sectioned at equal interval by dividing lines 54*a*-54*e*, are provided. The dividing lines 54*a*-54*e* correspond to the rotation distances of one fourth (¼) of the entire circumstance of the photoreceptor drum 5. Namely, the distance between the dividing lines 54*a* and 54*e* corresponds to one circumference of the photoreceptor drum 5. Each of the cleaning areas 53 that are sectioned by the dividing lines 54 corresponds to one of the cleaning areas 53 of the photoreceptor drum 5.

Figure 9:
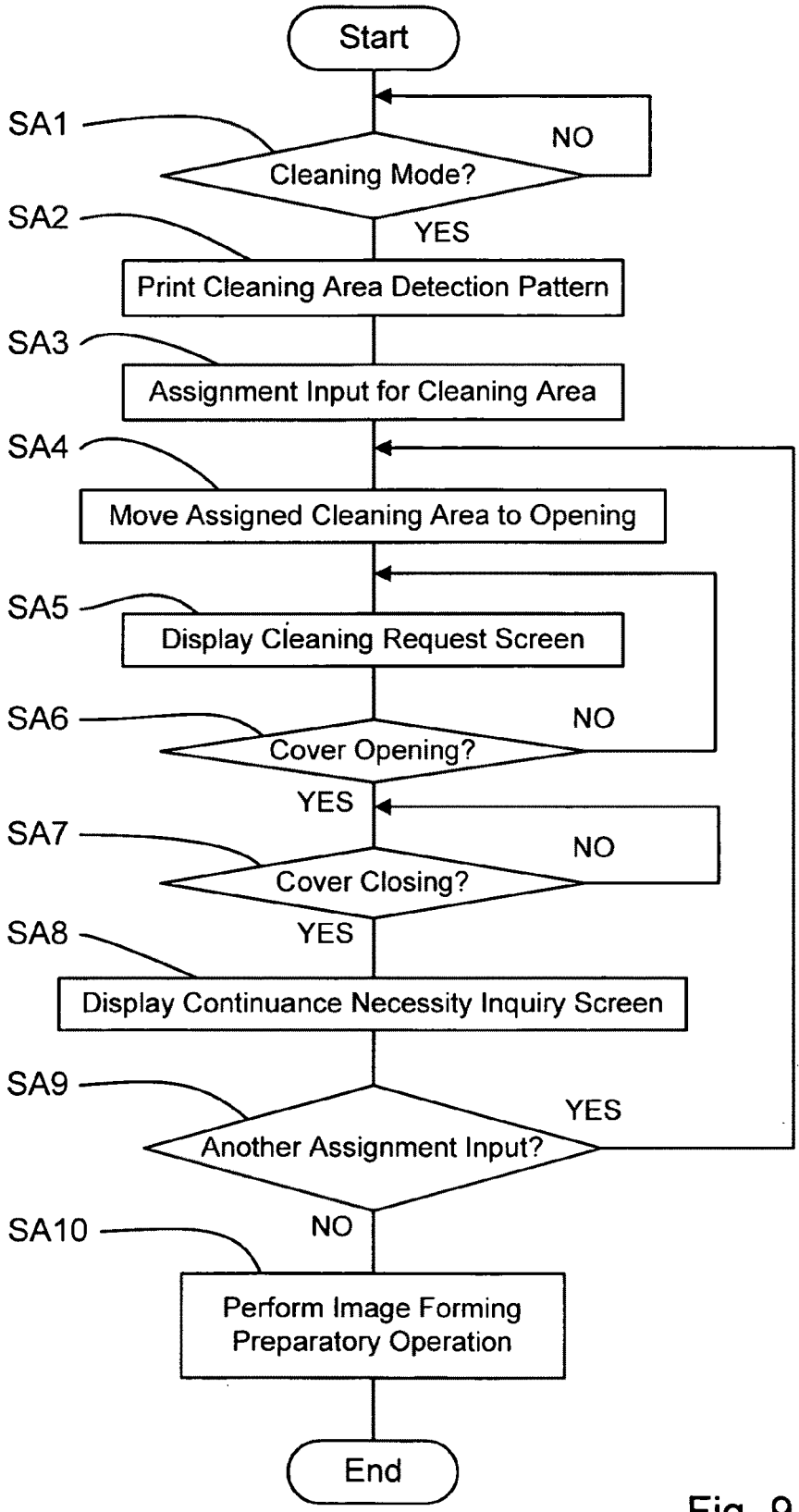
FIG. 9 is a flow diagram of a cleaning process of a second embodiment.

The cleaning treatment of the present embodiment is explained below according to the steps of a flow diagram shown in FIG. 9. The operation of SA1 in this embodiment is same as the operation of S1 in the first embodiment; thus, an explanation of the operation of SA1 is omitted. At SA2, when the control unit 30 determines the selection of the cleaning mode, the control unit suspends the operation of the image forming processing and prints the cleaning area detection pattern as shown in FIG. 8 to start the sequence of the cleaning mode.

That is, the control unit 30 reads the image data for the cleaning area detection pattern that is stored in the memory unit 32. The control unit 30 instructs that the photoreceptor drum 5 be rotated. While the memory unit 32 times the rotation time after the position detection sensor 51 detects the position mark 50, the control unit 30 sends the image data to the exposure head control unit 36. Then, an electrostatic latent image of the cleaning area detection pattern is formed on the photoreceptor drum 5 through the light emitting operation of the exposure head 4.

The control unit 30 stores each of the rotation time from the position mark 50 through the time when each of the electrostatic latent images for the dividing lines 54 is formed. After a toner image of the cleaning area detection pattern is fused by the fuser 17, the sheet P on which the cleaning area detection pattern is printed is ejected on the stacker 19 by the ejecting rollers 18. At SA3, the user confirms that the blot Y is located in the cleaning area 53*b* with the area number 2 in FIG. 8 through observing the sheet P on which the cleaning area detection pattern is printed. The user inputs the area number 2 through the operation unit 39 and performs the assignment input for the cleaning area 53*b*.

At SA4, when the control unit 30 receives the assignment input for the cleaning area 53*b*, the control unit 30 specifies the cleaning area 53*b* based on the input area number 2. The control unit 30 reads the rotation time for the dividing line 54*b*, which is located on the upstream side in the rotating direction of the cleaning area 53*b*, from the memory unit 32. The control unit 30 instructs that the photoreceptor drum 5 be rotated for the rotation time for the dividing line 54*b* that is read from the memory unit 32 after the position detection sensor 51 detects the position mark 50. The control unit 30 further instructs that the photoreceptor drum 5 be rotated for a certain rotation distance in order to expose the cleaning area 53*b*, which corresponds to the exposure length A of the surface of the photoreceptor drum 5, at the opening 26. And then, the control unit 30 instructs to stop the rotation of the photoreceptor drum 5.

As a result, the cleaning area 53*b* that is assigned by the area number 2 is moved to the position of the opening 26 and can be cleaned through the opening 26. At SA5, after the cleaning area 53*b* is moved to the position of the opening 26, the control unit 30 instructs that a cleaning request screen, which contains a message for encouraging the cleaning of the photoreceptor drum 5 for the user, the treatment procedure of the cleaning task, and so on, be displayed at the display unit 40 by the display control unit 41.

At SA6, after the control unit 30 instructs that the cleaning request screen be displayed, the control unit 30 waits for a cover opening signal that is outputted by the cover opening and closing detection sensors 42. When the cover opening and closing detection sensors 42 outputs the cover opening signal, the operation proceeds to SA7. When the cover opening and closing detection sensors 42 does not output the cover opening signal, i.e., when the cover opening and closing detection sensors 42 outputs a cover closing signal, the operation returns to SA5, so that the control unit 30 continues waiting while the control unit 30 causes the cleaning request screen to be displayed.

At SA7, when the control unit 30 determines that the cover opening signal has been output, the control unit 30 waits for the cover closing signal that is output from the cover opening and closing detection sensors 42. When the cover opening and closing detection sensors 42 outputs the cover closing signal, the operation proceeds to SA8. When the cover opening and closing detection sensors 42 do not output the cover closing signal, i.e., when the cover opening and closing detection sensors 42 output the cover opening signal, the control unit 30 continues waiting for the end of the cleaning of the photoreceptor drum 5.

In this case, because the cleaning task by the user is the same as that in the first embodiment, an explanation is omitted. At SA8, after the control unit 30 confirms the end of the cleaning of the cleaning area 53*b* in the photoreceptor drum 5 through the output of the cover opening signal, the control unit 30 instructs the display control unit 41 to display a message inquiring whether to continue the cleaning mode, to end the operation of the cleaning task, and so on, at the display unit 40.

When the user continues the cleaning mode, the user inputs the area number for the cleaning area that is cleaned next through the operation unit 39. When the user ends the cleaning mode, the user pushes an input key for instructing the end of the cleaning mode, such as an "online" key. At SA9, when the assignment input, the area number for the cleaning area that is cleaned next, is input, the operation returns to SA4. Then, the control unit 30 instructs that the cleaning area 53 that is assigned as the area number to the position of the opening 26 and instructs that the cleaning area 53 be cleaned.

When the assignment input for ending the cleaning mode is input, the control unit 30 determines the end of the cleaning mode and cancels the cleaning mode. And then, the operation proceeds to SA10. Because the operation at SA10 is the same as the image forming preparatory operation at S9 of the first embodiment, an explanation is omitted. As discussed above, the cleaning treatment is performed. When the cleaning mode is selected, the cleaning area 53, which had the blot Y, is specified by observing the sheet P on which the cleaning area detection pattern is printed. The cleaning of the photoreceptor drum 5 is performed by assigning the area number. When the cleaning mode is ended, the residual materials, which cause the occurrence of the blot Y and exists in an area of one fifth (⅕) of the surface of the photoreceptor drum 5, can be completely removed. Therefore, the area of one fifth (⅕) of the surface of the photoreceptor drum 5 is completely cleaned. At the same time, the cleaning task for the photoreceptor drum 5 is streamlined by omitting the cleaning task for the areas in which the blot Y does not exist.

As explained above, this embodiment has the following effects in addition to the effects of the first embodiment. When the cleaning mode is selected, the cleaning area detection pattern is printed on the sheet P. Only the cleaning area in which the blot Y exists is cleaned. Because the cleaning task for the areas in which the blot Y does not exist is omitted, the cleaning task, which is for restoring the image quality, for the photoreceptor drum 5 is relatively more efficient.

Figure 10:
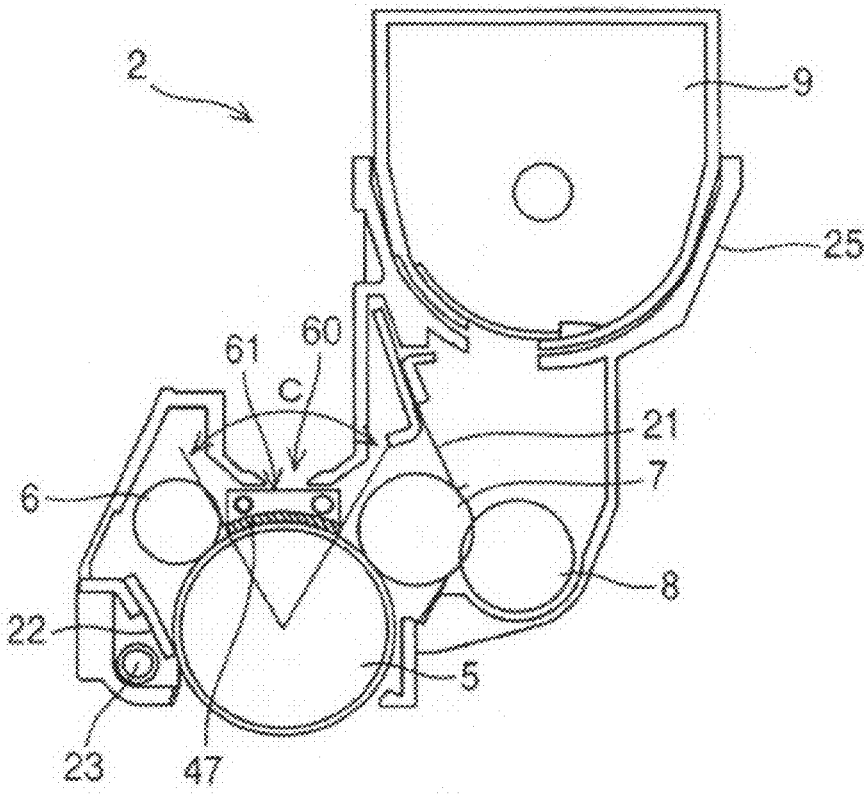
FIG. 10 is a side view of a process cartridge of a third embodiment.

(Third Embodiment) In an explanation of this embodiment, the same reference numerals are used for the same structures of the first embodiment, and detailed explanations for them are omitted. As shown in FIG. 10, a process cartridge 2 of this embodiment has an opening 60 that is located in an area including an exposing area in which the photoreceptor drum 5 faces the exposure head 4. A drum cleaning unit 61, or cleaning member moving mechanism, is located to the side of the photoreceptor drum 5 in the opening 60.

Figure 11:
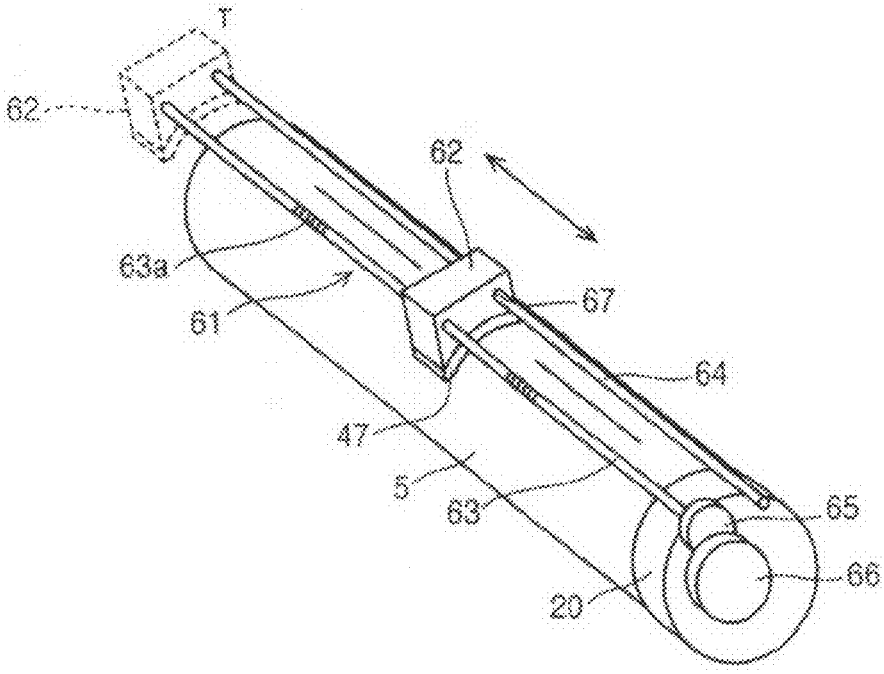
FIG. 11 is a schematic view of a drum cleaning member of a third embodiment.

As shown in FIG. 11, the drum cleaning unit 61 is configured with a cleaning member holder 62 that is made of a block of insulation resin fixed together with the cleaning member 47 (nonwoven cloth, a sponge, and so on are appropriate in this embodiment) on the surface of the holder 62 that opposes the photoreceptor drum 5, a drive shaft 63 on which the cleaning member holder 62 reciprocates, a guide shaft 64 that supports and guides the moving of the cleaning member holder 62, and a gear 65 that is fixed at one end of the drive shaft in the shaft direction. When the process cartridge 2 is attached to the printer 1, the gear 65 mates with a gear 66 that transmits the rotary drive force of a drive motor that is located in the printer 1.

The drive shaft 63 is parallel to the axis of the photoreceptor drum 5. A spiral groove 63*a*, which has a circular shape in its cross section and is formed in a spiral shape, is formed on the entire outer circumference of the drive shaft 63. A nut groove (not shown), which has a circular shape in its cross section and corresponds to the spiral groove 63*a*, is formed in a through hole on one side of the cleaning member holder 62 along its moving direction. The nut groove and the spiral groove 63*a* are mated through a ball as a rolling element. The guide shaft 64 is loosely fitted in a through hole 67 on the other side of the cleaning member holder 62, as shown. The guide shaft 64 is also parallel to the axis of the photoreceptor drum 5.

The drive shaft 63 and the guide shaft 64 support the cleaning member holder 62 so that the cleaning member holder 62 reciprocates in the axial direction of the photoreceptor drum 5. Because the drive shaft 63 rotates, the cleaning member 47 of the cleaning member holder 62 slides on the surface of the photoreceptor drum 5 and cleans the surface by wiping off residual materials adhered to the surface. At the time of the image forming, the cleaning member holder 62 of the present embodiment is located in an area in which the cleaning member 47 does not contact the surface of the photoreceptor drum 5 and outside of the image forming area. As shown in FIG. 11, the cleaning member 47 is located in an escape position T of the drive shaft and the guide shaft 64 that is outside of the image forming area of the photoreceptor drum 5. At the time of the cleaning treatment, i.e., not during image formation, the cleaning member 47 contacts and slides on the surface of the photoreceptor drum 5 by the control of the drive motor.

Figure 12:
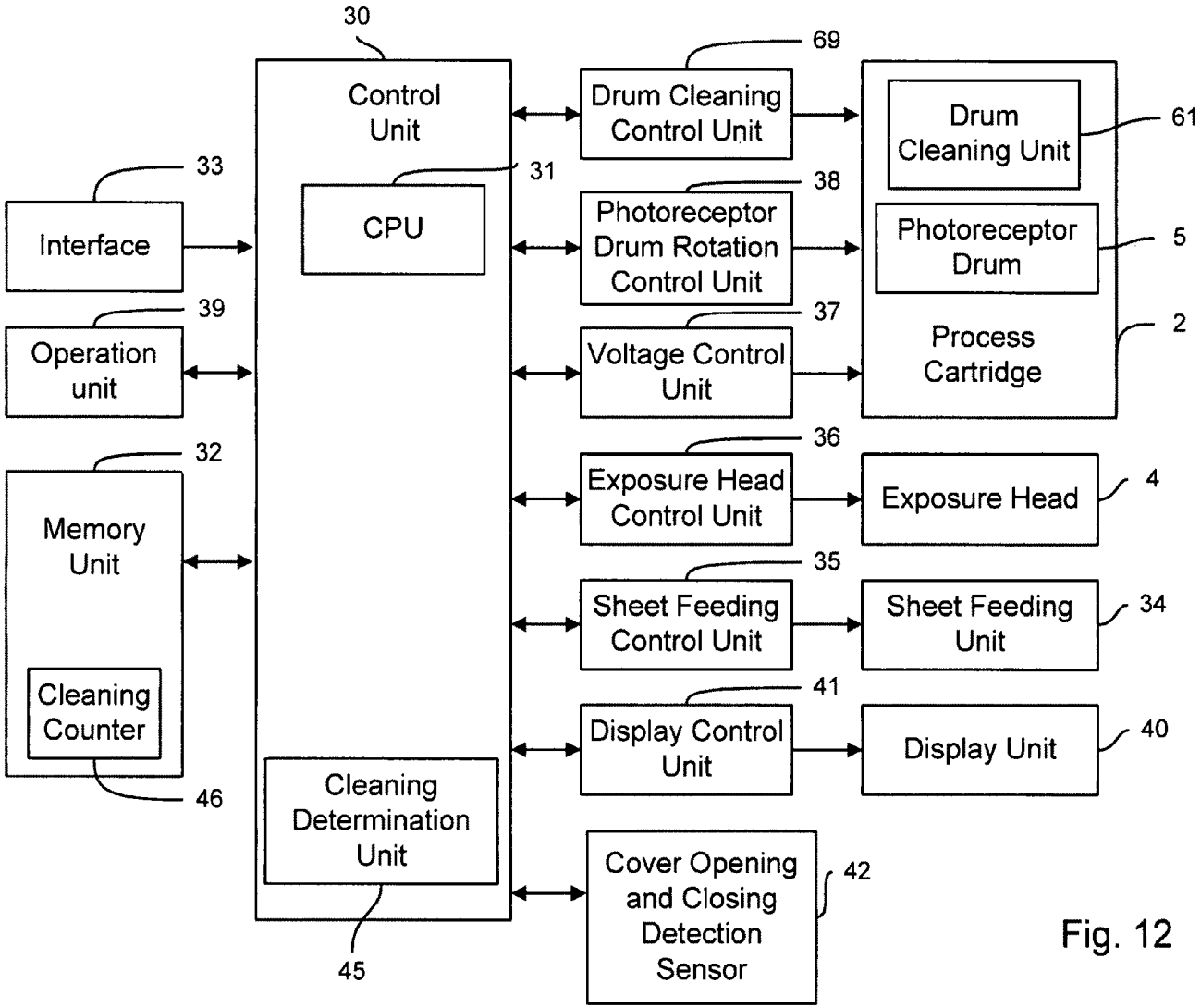
FIG. 12 is a block diagram showing a control system of a cleaning process of a third embodiment.

In the opening 26 of the process cartridge 2 of the present embodiment, an opening width C (a circular length of the outer circumference of the photoreceptor drum 5 that the cleaning member 47 contacts) of the surface of the photoreceptor drum 5 to which the cleaning member 47 contacts and cleans is 13 mm. The control system for the cleaning treatment of the present invention is shown in FIG. 12. The drum cleaning unit 61 is provided at the process cartridge 2. The moving operation of the drum cleaning unit 61 is controlled by a drum cleaning control unit 69.

In this embodiment, the cleaning mode can be selected from the menu that is displayed at the display unit 40. When the cleaning mode is selected by an input key of the operation unit 39, the cleaning determination unit 45 that is located at the control unit 30 determines the cleaning mode. The rotation operation by one rotation unit of the cleaning treatment is performed based on operation instructions of the cleaning treatment. The number of rotation units N of the rotation operation is counted by the cleaning counter 46 that is provided in the memory unit 32.

The cleaning mode of the present embodiment has the following sequence to clean the entire surface of the photoreceptor drum 5. The rotation distance, which that is equal to or shorter than the opening width C of the photoreceptor drum 5, is set as one rotation unit for the rotation operation of the photoreceptor drum 5. When the photoreceptor drum 5 is rotated by one rotation unit through the photoreceptor drum rotation control unit 38, the photoreceptor drum 5 is automatically cleaned by the cleaning member 47 of the drum cleaning unit 61 at each rotation unit. When the cleaning treatment discussed above is repeated several times, the entire surface of the photoreceptor drum 5 is cleaned.

In this case, the rotation speed of the photoreceptor drum 5 can be arbitrarily-configured. In this embodiment, the rotation speed is set so that the circumferential velocity is 90 mm/sec, and the rotation time is set as 0.13 sec. The rotation distance of the outer circumference of the photoreceptor drum 5 in one rotation unit is 11.8 mm. This rotation distance corresponds to the circular length of the outer circumference in the circumference direction of the photoreceptor drum 5 that is wiped by the cleaning member 47. This rotation distance is shorter than the opening width C, 13 mm, of the photoreceptor drum 5 as discussed above and corresponds to the rotation distance of one eighth (1/8) of the entire circumference of the photoreceptor drum 5.

Figure 13:
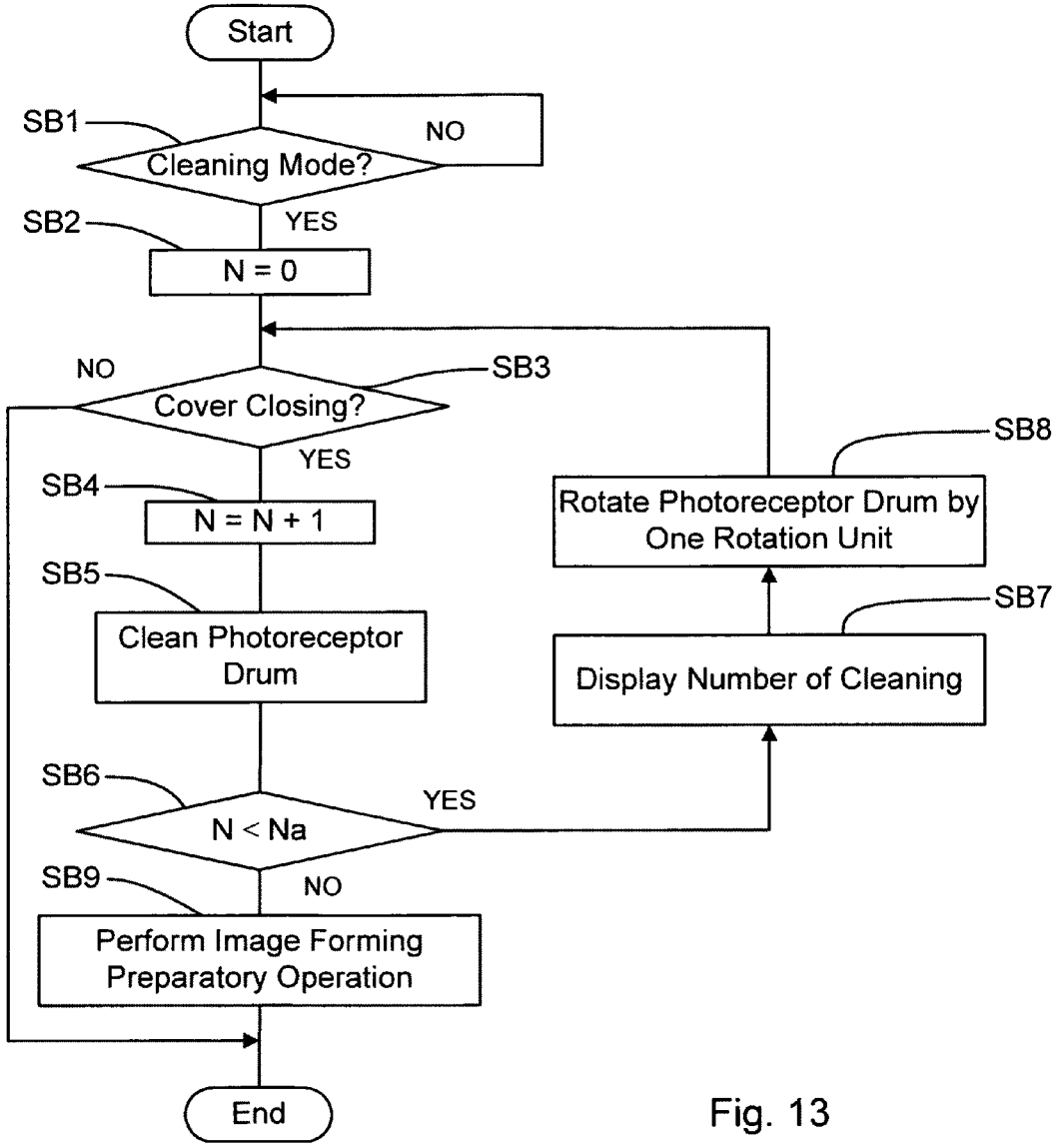
FIG. 13 is a flow diagram of a cleaning process of a third embodiment.

Therefore, the count upper limit Na of the number of rotation units N is eight and is stored in the memory unit 32. The cleaning treatment of the present embodiment is explained below according to Step SB with reference to a flow diagram shown in FIG. 13. The operations of SB1 and SB2 in this embodiment are same as the operations of S1 and S2 in the first embodiment, and explanations of the operations of SB1 and SB2 are omitted.

At SB3, the control unit confirms the output state of the cover opening and closing detection sensor 42. The cover opening and closing detection sensor 42 outputs the cover closing signal, the operation proceeds to SB4. When the cover opening and closing detection sensor 42 does not output the cover closing signal, i.e., when the cover opening and closing detection sensor 42 outputs the cover opening signal, the control unit 30 instructs termination of the cleaning mode. Because the cleaning mode of the present embodiment is performed while the cover is open, the surface of the photoreceptor drum 5 is exposed with external light, and toner is consumed. Therefore, the feature discussed above reduces toner consumption.

At SB4, when the control unit 30 confirms that the covers are closed, the control unit 30 adds one as a count number to the number of rotation units N of the cleaning counter 46 so that the number of rotation units N is increased incrementally. Thus, at this stage, N is equal to one. At SB5, after the control unit 30 increases the number of rotation units N incrementally, the control unit 30 instructs that the photoreceptor drum 5 be cleaned by the cleaning member 47 of the drum cleaning unit 61.

Because the control unit 30 instructs the drum cleaning control unit 69 to control the drive motor of the drum cleaning unit 61, the cleaning member holder 62 starts moving from the escape position T along the whole length of the photoreceptor drum 5 in its longitudinal direction and returns back to the original escape position T. While the cleaning member holder 62 is moving, the cleaning member 47 slides on the surface of the photoreceptor drum 5. Therefore, the cleaning member 47 wipes off and removes the residual materials that are adhered to the surface of the photoreceptor drum 5.

At SB6, when the control unit 30 determines that the Nth time of the cleanings of the number of rotation units N for the photoreceptor drum 5 is finished by returning the cleaning holder 62 back to the original escape position T, the control unit 30 compares the count upper limit Na with the number of rotation units N in the memory unit 32. When the number of rotation units N is equal to or more than the count upper limit Na (eight in the present embodiment), the control unit 30 determines the end of the cleaning mode and cancels the cleaning mode. Then, the operation proceeds to SB9.

When the number of rotation units N is less than the count upper limit Na, the control unit 30 determines the continuance of the cleaning mode. Then, the operation proceeds to SB7. At SB7, after the control unit 30 determines the continuance of the cleaning mode, the control unit 30 reads the count upper limit Na and the number of rotation units N in the memory unit 32 and instructs the display control unit 41 to display a cleaning number screen in which the number of rotation units N is displayed as the cleaning number at the display unit 40.

In this case, the cleaning number is displayed as, for example, "1/8" in which the count upper limit Na is a denominator. At SB8, after the control unit 30 instructs the display of the cleaning number screen, the control unit 30 instructs the photoreceptor drum rotation control unit 38 to rotate the photoreceptor drum 5 by one rotation unit. Then, after the operation returns to SB3, the cleaning of the photoreceptor drum 5 at the next number of rotation units N is performed with the same procedure discussed above until the number of rotation units N is equal to or more than eight.

In the rotation operation by one rotation unit of the photoreceptor drum 5, exposing control of the exposure head 4 and applied voltage for the process cartridge 2 are set so that toner does not adhere to the photoreceptor drum 5. Specifically, the exposure head 4 does not light, and the applied voltages to the process cartridge 2 are as follows: −1000 V to the charge roller 6 and −200 V to the developing roller 7. The operation of the following stop SB9 is same as the image forming preparatory operation at S9 of the first embodiment. Therefore, an explanation is omitted.

Because the photoreceptor drum 5 is automatically cleaned with the selection of the cleaning mode, one circumference of the photoreceptor drum 5 has been completely cleaned at the time the cleaning mode is terminated. In the present embodiment, the count upper limit Na is set as eight. However, the present invention is not limited to this embodiment. The setting of the count upper limit Na can be changed as long as each rotation distance is equal to or less than the opening width C by the operation unit 39.

The forced termination of the cleaning mode may be selected by the operation unit 39 through the same method that is discussed in the first embodiment above. In this embodiment, the following situation is explained as an example. In this embodiment, the following situation is explained as an example. When the number of rotation units N reaches the count upper limit Na, the cleaning mode is canceled. However, the present invention is not limited to this embodiment. The cleaning mode may continue when the number of rotation units N exceeds the count upper limit Na through the same method that is discussed in the first embodiment.

In this embodiment, the opening 26 of the process cartridge 2 is located in the exposing area opposite to the exposure head 4. However, when the cleaning member holder 62 interferes with the exposure head 4, a mechanism that enables the exposure head 4 to lift up by a cam is provided at the printer 1 as an example. When the cleaning mode is selected, the exposure head 4 is lifted up through the operation of the cam to the position where the cleaning member holder 62 does not interfere with the exposure head 4. And then, the sequence of the cleaning mode is performed.

In the present embodiment, the spiral groove 63*a* of the drive shaft 63 that moves the cleaning member holder 62 mates with the nut groove through the ball. However, the present invention is not limited to this embodiment. A triangle screw thread or a trapezoidal screw thread that is formed on the outer circumference of the drive shaft 63 mates with a screw part that is formed at the cleaning member holder 62 so that the cleaning member holder 62 can be moved. In the present embodiment, the escape position T for the cleaning member holder 62 is located in an extended part outside of the image forming area of the photoreceptor drum 5 in the moving direction of the cleaning member holder 62. However, the present invention is not limited to this embodiment. The escape position T can be located outside of the image forming area in the radial direction of the photoreceptor drum 5 through a link mechanism. The escape position can be varied as long as the escape position T is located in an area that is outside of the image forming area of the photoreceptor drum 5 and away from the surface of the photoreceptor drum 5.

In the present embodiment, the start of the cleaning mode is based on the selection of the menu through the operation unit 39. However, the present invention is not limited to this embodiment. The control unit 30 can automatically start the cleaning mode according to the number of printed sheets, usage environment, and so on. In this case, the adhesion of the residual materials on the surface of the photoreceptor drum 5 can be prevented before a defect in the image occurs. As explained above, this embodiment has the following effects in addition to the effects of the first embodiment. When the cleaning mode is selected, the photoreceptor drum 5 repeatedly and automatically rotates by the rotation unit that is equal to or less than the opening width C that is a area to be cleaned. As a result, the cleaning of the surface of the photoreceptor drum 5 becomes easy. It is possible that not only the cleaning is performed after the residual materials are adhered by the filming and so on, but also the adhesion of the residual materials on the surface of the photoreceptor drum 5 can be prevented before a defect appears through periodic cleaning treatment.

In the above embodiments, the image forming device is explained by using the printer as an example that uses the single-component contact development system in the tandem type in which a color image is transferred by one cycle through the four process cartridges. However, the present invention is not limited to these embodiments. The image forming device can be a multi-function printer (MFP), a facsimile machine, a copier, and so on. The image forming device can also be a black-and-white printer with one process cartridge, a color printer in which the transferring is repeated for four times by using an intermediate transferring belt, a printer with a single-component non-contact development system or a two-component development system, and so on.

What is claimed is:

1. An image forming device having a detachable image forming unit that has an image carrier and an opening that exposes a part of the surface of the image carrier comprising:

a determination unit that determines a cleaning time for the image carrier; and a rotation control unit that rotates the image carrier by a rotation unit that is less than or equal to a width of the opening, during the cleaning time.

2. The image forming device according to claim 1, wherein the image forming unit has a cleaning member that is configured to contact the surface of the image carrier in the opening, and the cleaning member is configured to separate from the surface of the image carrier during an image forming operation.

3. The image forming device according to claim 2, wherein the image forming unit has a cleaning member moving mechanism by which the cleaning member is separated from the image carrier and slides on the surface of the image carrier as the cleaning member is separated from the image carrier.

4. The image forming device according to claim 1, wherein the rotation control unit controls the rotation unit to rotate by one rotation unit between cleaning intervals until the image carrier rotates by at least one complete rotation unit.

5. The image forming device according to claim 1, wherein the opening is positioned within a transferring area that is for transferring a developer image formed on the image carrier to a medium.

6. The image forming device according to claim 1, wherein the opening is positioned within an exposing area that is between an exposure device, which forms an electrostatic latent image on the image carrier, and the image carrier.

7. The image forming device according to claim 1, wherein the width of the opening is a circumferential length along the outer surface of the image carrier through which the cleaning of the surface of the image carrier exposed through the opening is performed.

8. The image forming device according to claim 1, wherein the width of the opening is a circumferential length along the outer surface of the image carrier through which the cleaning is performed when the cleaning member contacts the surface of the image carrier.

9. The image forming device according to claim 1, wherein the opening is located in a position where a user is able to clean an exposed area of the surface of the image carrier.

10. An image forming device having a detachable image forming unit that has a cylindrical image carrier and an opening that exposes a circumferential section of the surface of the image carrier, the device comprising:

a determination unit that determines a cleaning time for the image carrier; and a rotation control unit that exposes a first circumferential section of the image carrier through the opening for a cleaning operation and, after the cleaning operation, rotates the image carrier by a rotation unit that is equal to or less than a width of the opening, as measured in a circumferential direction of the image carrier, to expose a second circumferential section of the image carrier, wherein the rotation control unit exposes circumferential sections of the image carrier, one after another, until the entire circumferential surface of the image carrier has been exposed through the opening for the cleaning operation.

11. The image forming device according to claim 10 further comprising a cleaning mechanism, which is configured to wipe the exposed circumferential sections during cleaning operation.

12. The image forming device according to claim 11 further, wherein the cleaning mechanism is automatically driven to wipe the exposed circumferential sections while the image carrier is stationary.

13. The image forming device according to claim 11 further, wherein the cleaning mechanism includes a cleaning member, which is separated from the image carrier when the cleaning operation is not being performed.

14. The image forming device according to claim 11, wherein the opening is located within a transferring area, at which a developer image formed on the image carrier is transferred to a sheet.

15. A method of cleaning a cylindrical image carrier of a detachable image forming unit, wherein the image forming unit has an opening that exposes a part of the surface of the image carrier, the method comprising:

a) entering a cleaning mode;

b) exposing a part of the surface of the image carrier through the opening;

c) performing a first cleaning operation on the exposed part through the opening;

d) rotating the image carrier by a rotation unit that corresponds to a circumferential length along the surface of the image carrier that is less than a width of the opening, as measured in a circumferential direction of the image carrier, to expose another part of the surface of the image carrier;

e) repeating b), c) and d) until the entire circumference of the image carrier has been cleaned; and f) terminating the cleaning mode.

16. The method according to claim 15 further comprising controlling a cleaning mechanism to wipe the exposed part of the image carrier through the opening when the image carrier is stationary.

17. The method according to claim 15 further comprising controlling the cleaning mechanism to separate from the image carrier when the cleaning mode is terminated.

18. The method according to claim 15, wherein the opening is located within a transferring area, at which a developer image formed on the image carrier is transferred to a sheet.

19. The method according to claim 15, wherein the opening is located within an exposing area that is between an exposure device, which forms an electrostatic latent image on the image carrier, and the image carrier.

* * * * *